United States Patent [19]

Morris

[11] 4,372,377

[45] Feb. 8, 1983

[54] HEAT PIPES CONTAINING ALKALI METAL WORKING FLUID

[75] Inventor: James F. Morris, Fairview Park, Ohio

[73] Assignee: The United States of America as represented by the Administrator of the National Aeronautics and Space Administration, Washington, D.C.

[21] Appl. No.: 243,682

[22] Filed: Mar. 16, 1981

[51] Int. Cl.[3] ..... F28D 15/00

[52] U.S. Cl. ..... 165/104.26; 165/134 R; 29/157.3 H

[58] Field of Search ..... 165/104.21, 104.26, 165/134; 29/157.3 H

[56] References Cited

U.S. PATENT DOCUMENTS

| | | | |
|---|---|---|---|
| 3,426,220 | 2/1969 | Block et al. | 165/104.26 X |
| 3,602,297 | 8/1971 | Kraft et al. | 165/104.26 |
| 3,640,517 | 2/1972 | Sendt | 165/104.26 X |
| 3,802,875 | 4/1974 | Klein et al. | 75/171 |
| 3,907,552 | 9/1975 | Kennedy | 75/122 |
| 3,928,026 | 12/1975 | Hecht et al. | 75/134 F |

FOREIGN PATENT DOCUMENTS

| | | | |
|---|---|---|---|
| 1194530 | 6/1970 | United Kingdom | 75/171 |

OTHER PUBLICATIONS

G. J. Ewell et al., *Reliability of Low-Cost Liquid Metal Heat Pipes* Third International Heat Pipe Conf., AIAA, May 22-24, 1978, Palo Alto, CA, USA, pp. 1-6.

*Primary Examiner*—Albert W. Davis, Jr.
*Attorney, Agent, or Firm*—N. Musial; J. Manning; G. Shook

[57] ABSTRACT

This invention is concerned with improving high temperature evaporation-condensation heat-transfer devices which have important and unique advantage in terrestrial and space energy 5 processing. The device is in the form of a heat pipe 10 comprising a sealed container or envelope 12 which contains a capillary wick 14.

The temperature of one end of the heat pipe is raised by the input of heat from an external heat source 16 which is extremely hot and corrosive. A working fluid 18 of a corrosive alkali metal, such as lithium, sodium, or potassium transfers this heat to a heat receiver 20 remote from the heat source.

In accordance with the invention the container 12 and wick 14 are fabricated from a superalloy containing a small percentage of a corrosion inhibiting or gettering element. Lanthanum, scandium, yttrium, thorium, and hafnium are utilized as the alloying metal.

4 Claims, 1 Drawing Figure

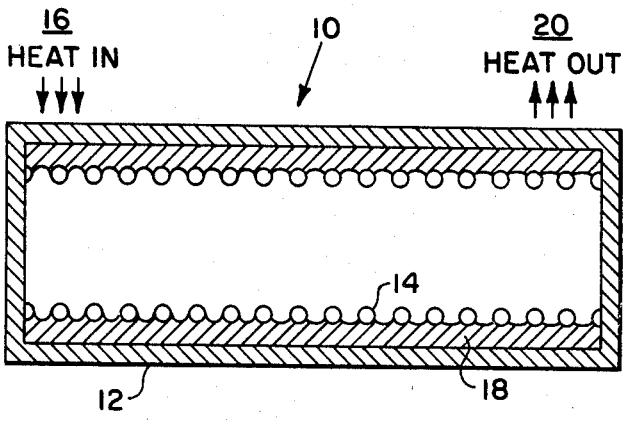
16
HEAT IN
10
20
HEAT OUT
14
12
18

HEAT PIPES CONTAINING ALKALI METAL WORKING FLUID

ORIGIN OF THE INVENTION

The invention described herein was made by an employee of the U.S. Government and may be manufactured and used by or for the Government for governmental purposes without the payment of any royalties thereon or therefor.

TECHNICAL FIELD

This invention is concerned with improving high temperature heat pipes containing alkali metals which have important and unique advantages in terrestrial and space energy processing. The invention is particularly directed to inhibiting high temperature corrosion of these heat pipes.

Metallic fluid heat pipes operate through the working fluid vaporization, condensation cycles that accept great thermal power densities at high temperatures. These heat pipes operate on thermal inputs only and have no moving parts. While metallic fluid heat pipes have relatively simple, isolated performance mechanisms, they also have difficult and complicated material problems.

Alkali metals, such as lithium, sodium and potassium are very efficient working fluids for heat pipes. However, because these metals are highly corrosive the heat pipe envelopes have been fabricated from high temperature refractory metals. Such materials are not suitable for applications where the heat sources are extremely hot, in a range above 800°-900° K.

Superalloys are capable of withstanding the high temperatures of such heat sources. However, these materials are not capable of resisting both the external corrosion from the environment of the heat source and the internal corrosion from the lithium working fluid.

PRIOR ART

British Pat. No. 1,194,530 and U.S. Pat. No. 3,602,297 to Kraft et al. disclose the use of a yttrium-containing tantalum-base alloy in alkali metal heat pipes. However, tantalum alloys cannot be used at high temperatures in corrosive atmopshere because they react very readily. Therefore, these tantalum alloys are completely undesirable for extremely high temperature service in air and combustion products.

DISCLOSURE OF INVENTION

These corrosion problems have been solved by using an alkali metal working fluid in a heat pipe constructed in accordance with the invention. All of the parts of the heat pipe which contact the working fluid are fabricated from a material which resist both the external corrison of the heat source and the internal corrosion of the working fluid.

Superalloys based on cobalt, chromium, and/or nickel are used in these heat pipes. These superalloys are alloyed with minor amounts of thorium, hafnium, yttrium, lanthanum, or scandium to increase the corrosion resistance of both the high temperature oxidizing atmospheres and the alkali metal.

BRIEF DESCRIPTION OF THE DRAWING

The objects, advantages, and novel features of the invention will be more fully apparent from the following detailed description when read in connection with the accompanying drawing which is a transverse cross-section of a heat pipe constructed in accordance with the invention.

BEST MODE FOR CARRYING OUT THE INVENTION

Referring now to the drawing there is shown an evaporationcondensation heat transfer device 10 in the form of a heat pipe constructed in accordance with the present invention. The heat pipe 10 is of the type shown and described in U.S. Pat. No. 3,229,759 to Grover.

The heat pipe 10 has a sealed container or envelope 12 which preferably has a tubular configuration. A suitable capillary wick 14 is fitted within the container 12 adjacent to the inner surface thereof.

The temperature of one end of the heat pipe 10 is raised by the input of heat from an external heat source 16. A supply of working fluid 18 within the sealed container 12 functions to transfer the heat to a heat receiver 20 remote from the heat source 16.

In operation the working fluid 18 vaporizes in the heated evaporator portion of the heat pipe 10 adjacent to the heat source 16. The working fluid flows as a vapor through a centrally disposed adiabatic section to the opposite end of the container 12. The working fluid gives up its heat of condensation in a cooled condenser portion of the heat pipe 10 adjacent to the heat receiver 20.

Thereupon the working fluid flows as a liquid back to the evaporator portion through the wick 14. The working fluid moves to the vaporizing surface through the wick capillarys and the working fluid recycles continuously. The heat pipe of the present invention is utilized with a heat source 16 that is extremely hot and highly corrosive. Lithium, sodium, and potassium have been satisfactory for the working fluid with such a heat source. Lithium is by far the most corrosive.

In accordance with the invention, the container is fabricated from a superalloy having a small percentage of a corrosion inhibiting or gettering element alloyed therewith. A metal selected from the group consisting of lanthanum, scandium, yttrium, thorium, and hafnium is utilized for this purpose.

A superalloy known commercially as Haynes Alloy 188 having about 1/10th of 1% by weight of lanthanum alloyed therewith has been found to be satisfactory for the container 12. The nominal composition of Haynes Alloy 188, in weight percent, is about 40% cobalt, about 22% nickel, about 22% chromium, about 14% tungsten, and about 2% iron.

A heat pipe 10 utilizing lithium as the working fluid and having a container fabricated with Haynes Alloy 188 with the lanthanum corrosion inhibitor alloyed therewith has been run at an evaporator temperature of about 1250° K. for over 19,000 hours. This heat pipe was a part of a project to determine advantages of very high temperature, hard-vacuum preloading bake-outs on lithium and sodium compatabilities with several superalloys during heat-pipe operation.

In practically all such preceding compatability studies, access to corrosion-accelerating impurities had been assured. While screen wicks were preferred for the aforementioned study, it was necessary to use metal-felt wicks which are difficult to clean. As a result, bake-out achieved only in the order of $10^{-4}$ torr rather than a desired lower vacuum of $10^{-7}$ torr.

Subsequently lithium heat pipes fabricated from superalloys other than Haynes Alloy 188 failed early with destroyed wicks and severe internal wall attacks. Two Haynes Alloy 188, lithium heat pipes developed leaks in stress cracks caused by welding after about 200 hours. However, sectioning and microscopic examintion revealed no lithium effects on the wicks or the walls.

While a preferred embodiment of the invention has been described it will be appreciated that various modifications may made to this structure without departing from the spirit of the invention or the scope of the subjoined claims.

I claim:

1. Apparatus for transferring heat from a source in a hot corrosive environment to a reciever remote from said source using a high temperature corrosive working fluid comprising a container fabricated from a superalloy containing cobalt, nickel, chromium, tungsten, and iron extending from said heat source to said receiver, capillary means (a wick) adjacent to the inner surface of said container, a lithium (an alkali metal) working fluid in said container for transporting heat from the source end of said container to the reciever end of said container in a vapor state and returning from said receiver end to said source end through said capillary means in a liquid state, and a corrosion inhibiting element selected from the group consisting of thorium, hafnium, lanthanum, and scandium alloyed with said superalloy to resist corrosion from both said hot corrosive environment of said source and said working fluid.

2. Apparatus as claimed in claim 1 wherein the container is fabricated from a superalloy containing in weight percent about 40% cobalt, 22% nickel, 22% chromium, 14% tungsten, and 2% iron.

3. Apparatus as claimed in claim 1 wherein the superalloy contains about 0.1% lanthanum.

4. Apparatus as claimed in claim 1 wherein the container and the capillary means are fabricated from the same superalloy.

* * * * *

UNITED STATES PATENT AND TRADEMARK OFFICE

CERTIFICATE OF CORRECTION

PATENT NO. : 4,372,377

DATED : February 8, 1983

INVENTOR(S) : James F. Morris

It is certified that error appears in the above-identified patent and that said Letters Patent are hereby corrected as shown below:

Column 4, line 1, cancel "(a wick)"

line 3, cancel "(an alkali metal)"

Signed and Sealed this

*Thirty-first* Day of *May 1983*

[SEAL]

*Attest:*

DONALD J. QUIGG

*Attesting Officer* *Acting Commissioner of Patents and Trademarks*